US008517496B2

(12) United States Patent
Sugimura et al.

(10) Patent No.: US 8,517,496 B2
(45) Date of Patent: Aug. 27, 2013

(54) APPARATUS AND METHOD OF PRINTING IMAGES ON A CONTINUOUS SHEET

(75) Inventors: Hideo Sugimura, Tokyo (JP); Shinya Asano, Tokyo (JP); Takashi Nojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 148 days.

(21) Appl. No.: 12/964,063

(22) Filed: Dec. 9, 2010

(65) Prior Publication Data

US 2011/0279509 A1 Nov. 17, 2011

(30) Foreign Application Priority Data

May 13, 2010 (JP) ..... 2010-111533

(51) Int. Cl.
*B41J 29/38* (2006.01)

(52) U.S. Cl.
USPC ..... 347/16

(58) Field of Classification Search
None
See application file for complete search history.

(56) References Cited

U.S. PATENT DOCUMENTS

| | | | | |
|---|---|---|---|---|
| 6,523,921 | B2 * | 2/2003 | Codos | 347/8 |
| 2005/0099439 | A1 * | 5/2005 | Folkins | 347/8 |
| 2005/0237548 | A1 * | 10/2005 | Suzuki | 358/1.9 |
| 2006/0279624 | A1 * | 12/2006 | Tsuchiya et al. | 347/218 |

FOREIGN PATENT DOCUMENTS

| | | | |
|---|---|---|---|
| JP | 2001-239715 | A | 9/2001 |
| JP | 2001239715 | A * | 9/2001 |

* cited by examiner

*Primary Examiner* — Geoffrey Mruk
*Assistant Examiner* — Bradley Thies
(74) *Attorney, Agent, or Firm* — Canon USA, Inc., IP Division

(57) ABSTRACT

A printing apparatus using a print head of an inkjet-type, in which, if a splice is detected during printing, an area of a following part of a continuous sheet that follows the splice is used to perform image-quality adjustment such as color shading adjustment, an adjustment of a gap between the print head and a sheet, and a color registration adjustment of the print head.

10 Claims, 5 Drawing Sheets

APPARATUS AND METHOD OF PRINTING IMAGES ON A CONTINUOUS SHEET

BACKGROUND OF THE INVENTION

1. Field of the Invention

The present invention relates to a printing apparatus that performs printing on a continuous sheet.

2. Description of the Related Art

A continuous sheet roll is used in printing a large number of prints, such as in lab printing. When producing a continuous sheet roll, from the viewpoint of improving manufacturing yield, a roll having a required length may be formed by joining ends of a plurality of continuous sheets whose lengths are less than the required length to each other with a joining material such as a splicing tape (hereafter referred to as "tape"). In the continuous sheet roll, splices (joints) joined to each other with a tape are randomly provided at more than one location.

In an apparatus discussed in Japanese Patent Laid-Open No. 2001-239715, control is performed so that printing is not performed on an area including the splice, that is, an unrecordable area, by detecting the position of the splice by detecting a tape using an optical sensor.

When printing, for example, a high-quality photographic image, a slight difference between the characteristics of sheets used (such as, sheet type, sheet quality, and sheet thickness) is manifested as a difference between print qualities. Therefore, if the characteristics of a leading sheet and a following sheet that are joined to each other at a splice of a continuous sheet differ from each other, images in front of and behind the splice have different qualities, such as different tones, gradations, and contrasts. A difference between print qualities of a plurality of pages of one printed material, such as a photographic album, causes a person to look at the printed material with an improper color tone, etc. Therefore, it is desirable for the print qualities of images which are successively printed on a continuous sheet be the same. Japanese Patent Laid-Open No. 2001-239715 does not acknowledge the existence of such a problem and does not discuss anything about a method of overcoming such a problem.

The present invention is carried out on the basis of an acknowledgement of the existence of the above-described problem. The present invention provides a technique of reducing differences between print qualities at portions in front of and behind a splice in performing printing on a continuous sheet having splices.

SUMMARY OF THE INVENTION

According to the present invention, there is provided an apparatus including a sheet feeding unit configured to feed a continuous sheet along a path; a print head of an inkjet-type configured to print images on the continuous sheet fed from the sheet feeding unit; and a detecting unit that detects a splice of the continuous sheet at a position between the sheet feeding unit and a printing unit in the path, wherein, if the splice is detected by the detecting unit, image-quality adjustment is performed using an area of the sheet that follows the splice.

Further features of the present invention will become apparent from the following description of exemplary embodiments with reference to the attached drawings.

DESCRIPTION OF THE EMBODIMENTS

An inkjet printing apparatus according to an embodiment of the present invention will hereunder be described. The printing apparatus according to the embodiment is a high-speed line printer that uses a long continuous sheet (that is longer than a print unit (such as one page or a unit image) that is repeated in a conveying direction), and that can perform one-side printing and two-side printing. For example, the inkjet printing apparatus is suitable in the field of printing a large number of prints in, for example, a print lab.

Figure 1:
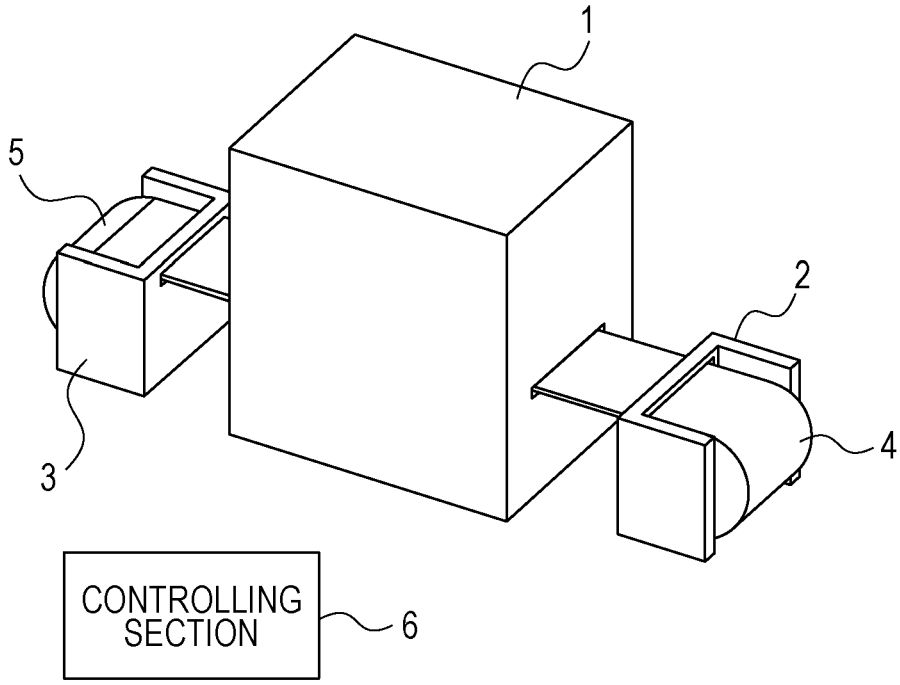
FIG. 1 is an external view of the entire printing apparatus according to an embodiment of the present invention.

FIG. 1 is an external view of the entire printing apparatus according to the embodiment of the present invention. The printing apparatus generally includes a printing unit 1, a sheet feeding unit 2, a sheet winding unit 3, and a controlling unit 6. The sheet feeding unit 2 holds a roll sheet 4, and feeds a continuous sheet to the printing unit 1 while pulling it out from the roll. In the printing unit 1, a plurality of images are successively printed on the continuous sheet. The continuous sheet that is subjected to the printing is wound upon the sheet winding unit 3 as a roll sheet 5. The controlling unit 6 includes a controller, a memory, and various I/O interfaces, and is in charge of controlling the entire printing apparatus. The controlling unit 6 may be built in the printing apparatus itself, or may be an external host computer connected to the printing apparatus. With respect to any position in the sheet conveying path, a side closer to the sheet feeding unit 2 is called an "upstream side", and a side opposite thereto is called a "downstream side".

A sheet held by the sheet feeding unit 2 is wound into the form of a roll if it is a continuous sheet. For example, it is possible to fold at each perforation a continuous sheet that is perforated with every unit length, stack the folded sheets upon each other, and accommodate the stacked sheets in the sheet feeding unit 2.

Figure 3:
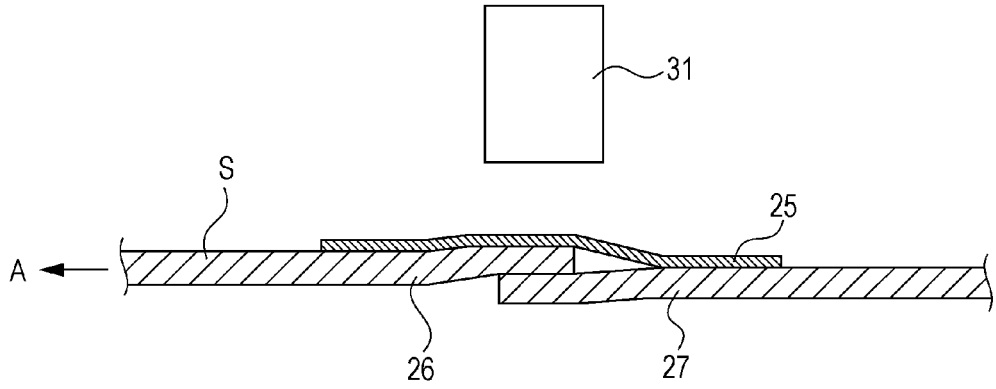
FIG. 3 is a unital view of a splice of a continuous sheet.

As shown in FIG. 3, in the continuous sheet used here, splices (joints) joined to each other with a tape or glue are randomly provided at more than one location. The continuous sheet is previously provided with splices when a roll is being manufactured. After using up one roll of continuous sheet, printing may be continued using a new continuous sheet formed by a user by joining sheets. Even in such a case, splices are formed in the continuous sheet.

In FIG. 3, a leading part of a continuous sheet (a leading sheet 26) and a following part of the continuous sheet (a following sheet 27) are joined to each other at a splice, so that one continuous sheet S is formed. In this embodiment, a portion of the leading sheet 26 and a portion of the following sheet 27 are placed upon each other and glued to each other. Then, a tape 25 is applied to the glued portions from thereabove. The portion where the tape 25 is applied corresponds to the splice. The overlapping portion of the sheets and the thickness of the tape 25 cause a stepped portion to be formed. Only this portion is thicker than the actual sheet thickness.

Figure 2A:
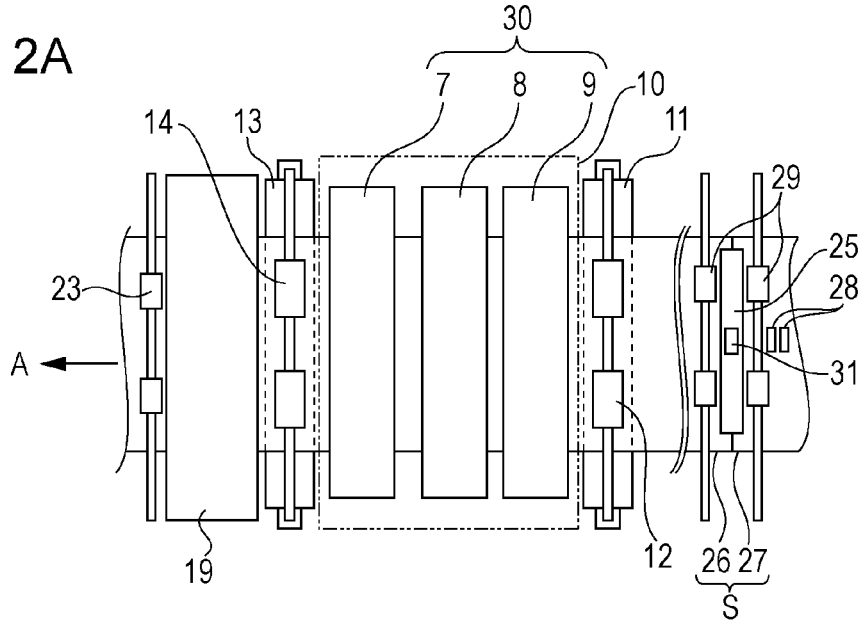
FIGS. 2A to 2C each illustrate an internal structure of a printing unit.
Figure 2B:
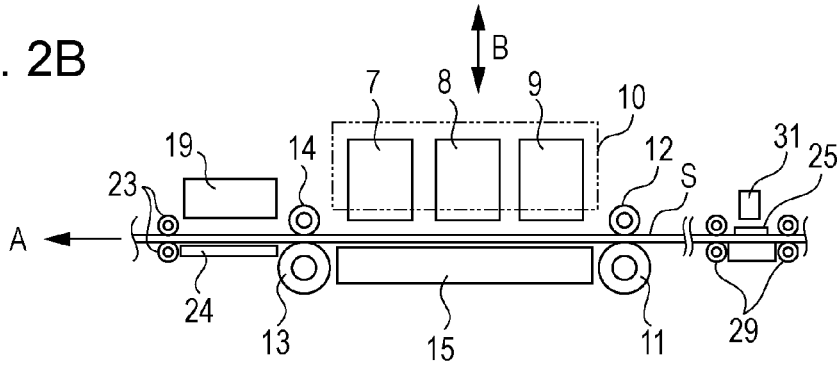
Figure 2C:
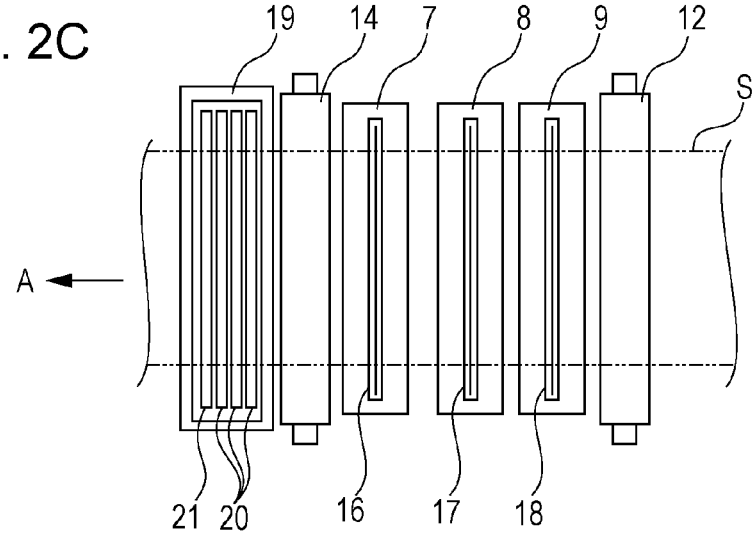

FIGS. 2A to 2C each illustrate an internal structure of the printing unit 1. FIGS. 2A and 2B are, respectively, a top view and a front view thereof. FIG. 2C is a bottom view of principal members disposed at the upper side of a sheet. A continuous sheet S fed to the printing unit 1 from the sheet feeding unit 2 is conveyed in the direction of arrow A in the printing unit. As sheet conveying mechanisms in the printing unit, an upstream conveying roller pair (including a conveying roller 11 and a pinch roller 12, which is a driven roller) and a downstream conveying roller pair (including a conveying roller 13 and a pinch roller 14, which is a driven roller) are provided. A platen 15 guides and holds a lower surface of the continuous sheet at a recording position. A print head unit 30 includes a plurality of print heads of an inkjet-type. Each print head has an inkjet nozzle row formed in a range that covers a maximum print width that is assumed be used. Each ink nozzle row may be one in which unit nozzle chips are regularly disposed in, for example, a staggered arrangement, or one that is formed over an entire area in a widthwise direction. For an inkjet method, for example, a method using heating elements, a method using piezo-elements, a method using electrostatic elements, or a method using MEMS elements may be used. Inks of respective colors are fed to the respective print heads from ink tanks through respective ink tubes. In the embodiment, the print head unit 30 includes three heads, that is, a cyan head 7 for cyan ink, a magenta head 8 for magenta ink, and a yellow head 9 for yellow ink. As shown in FIG. 2C, a nozzle row 16 is formed in a discharge surface of the cyan head 7, a nozzle row 17 is formed in a discharge surface of the magenta head 8, and a nozzle row 18 is formed in a discharge surface of the yellow head 9. The number of colors and the number of print heads are not limited to three, so that they may be greater than or less than three. The ink tubes are connected to the print heads, so as to allow the inks to be fed from the ink tanks (not shown). Each print head may be integrated to its corresponding ink tank containing the ink of the corresponding color, to form one unit. The print heads are held together by a head holder 10. The head holder 10 can be raised and lowered in the direction of arrow B by a driving mechanism.

A scanner apparatus 19 (reading unit) is positioned downstream from the downstream conveying roller pair (pinch roller 14). It is used to read a test image or an image-quality adjustment image printed on a continuous sheet using the print head unit 30. As shown in FIG. 2C, the scanner apparatus 19 includes a light-emitting unit and a photodetector. The light-emitting unit includes light-emitting elements 20 for three colors, that is, the R light-emitting element 20, the G light-emitting element 20, and the B light-emitting element 20. The photodetector includes an image sensor 21 (a CCD image sensor or a CMOS image sensor). A white reference plate 24 is disposed so as to oppose a reading position of the image sensor 21 with a sheet being disposed therebetween. The white reference plate 24 is a white plate, and is used in color calibration of the image sensor 21. A discharge roller pair 23 for discharging the continuous sheet is provided downstream from the scanner apparatus 19 and the white reference plate 24.

A detecting unit 31 for optically detecting a splice (tape 25) of the continuous sheet from above a sheet surface by a non-contact method is provided upstream from the upstream conveying roller pair (pinch roller 12). The detecting unit 31 includes a light-emitting unit and an array sensor. The light-emitting unit obliquely illuminates the sheet surface with light. The array sensor detects reflected light. The leading sheet 26 and the following sheet 27 are both white, so that they both are glossy and have high reflectivity. In contrast, the surface of the tape 25 is black and is subjected to mat processing, so that it has low light reflectivity. Making use of the difference between the reflectivities, the detecting unit 31 detects that the tape 25 at the splice has passed a sensor detection position. The detecting unit 31 can also detect the height of the sheet surface by determining which of the two or more photodetectors that the array sensor is provided with primarily receives the reflected light. Two guide roller pairs 29 are provided, one on the upstream side and one on the downstream side of the detecting unit 31. When the position of the detecting unit 31 in a sheet height direction at the detection position is stabilized, the detection precision is stabilized.

Figure 4:
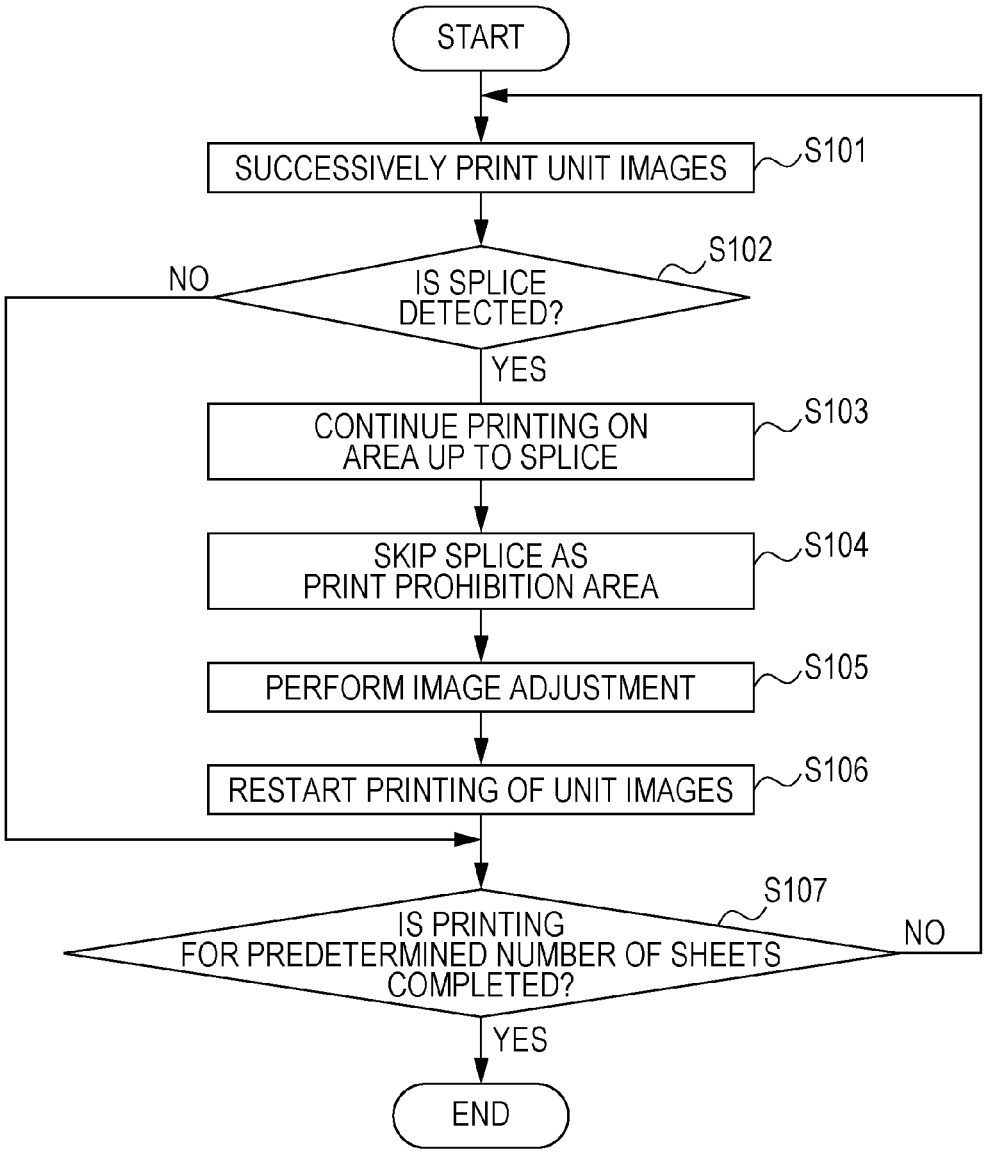
FIG. 4 is a flowchart of an entire sequence of a printing operation.

FIG. 4 is a flowchart of an entire sequence of a printing operation that is controlled by the controlling unit 6. In Step S101, successive printing of a plurality of unit images on a continuous sheet is started. In Step S102, during the printing, the detecting unit 31 detects a splice of the continuous sheet. If a splice is detected (Yes), the process proceeds to Step S103. If not (No), the process proceeds to Step S107.

In Step S103, the printing of unit images is continued, and as many unit images as possible are printed until the detected splice moves to a print position of the upstreammost yellow head 9 of the print head unit 30. The length of the conveying path from the detection position of the detecting unit 31 to the print position of the upstreammost yellow head 9 is detected in terms of design. Therefore, whether or not several unit images can be printed in an area of this length can be calculated from the length of a unit image in the conveying direction.

In Step S104, an area including a splice is set as a print prohibition area. This area is skipped and not subjected to printing when it passes the print position. Therefore, the print prohibition area is a blank without ink being applied thereto.

In Step S105, after the splice passes the print position, an area of the following sheet that follows the splice is used to perform image quality adjustment of the print head unit 30. One example of the image quality adjustment is color shading adjustment. "Color shading" refers to a phenomenon in which, for example, a color tone changes in accordance with the characteristics of a sheet to which ink is applied. If the sheet characteristics of the leading sheet 26 and the following sheet 27 are not the same, a user recognizes the difference between the sheet characteristics as different color tones. "Color shading adjustment" refers to data processing for performing printing using the actual color tone by proper correction in accordance with the sheet characteristics. Using the print heads of the respective colors, adjustment patterns for the color shading adjustment are printed on a leading area of the following sheet that follows the splice. The scanner apparatus 19 reads the printed adjustment patterns, and the controlling unit corrects driving of the print heads of the respective colors on the basis of read results.

Figure 5:
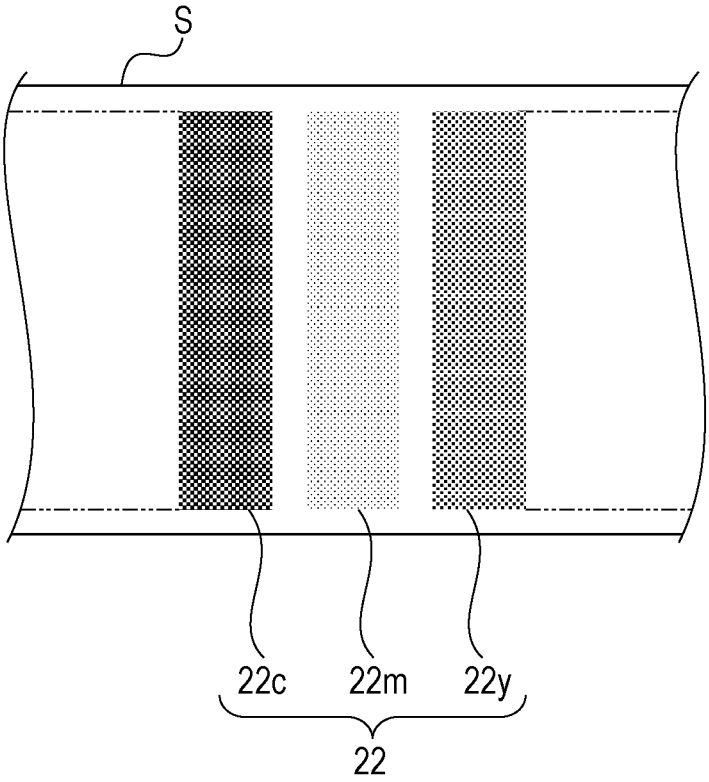
FIG. 5 shows an exemplary adjustment pattern for color shading adjustment.

FIG. 5 shows exemplary adjustment patterns 22 for color shading adjustment. Using the print heads of the three colors of the print head unit 30, a cyan pattern 22*c*, a magenta pattern 22*m*, and a yellow pattern 22*y* are printed and formed on the leading area of the following sheet 27 with a predetermined duty. The scanner apparatus 19 reads the adjustment patterns 22, to obtain image data. At the controlling unit, the densities of the respective colors are determined from the read image data, to adjust ink discharge amounts of the respective print heads. The patterns of the respective colors are formed while inkjet discharge energy in the conveying direction is slightly changed in an up-down direction with respect to a design value. The discharge energy applied to the print heads and recording positions within the patterns are made to correspond to each other, and are stored as a data table in a memory of the controlling unit. The scanner apparatus 19 reads the printed adjustment patterns as multi-valued data for the respective three colors, R, G, and B. From images that have been read, the controlling unit determines a recording position that is closest to ideal color balance data in the memory.

Then, referring to the data table, the discharge energy that drives the print heads is set, to continue printing on the following sheet 27. Even on the leading sheet 26, color shading that is in accordance with the characteristics of the leading sheet 26 are similarly performed first. Accordingly, even if the characteristics of the leading sheet 26 and the following sheet 27 differ from each other, images are printed on both of these sheets with the same color tone, so that a user does not look at the printed images with an improper color tone, etc.

Returning to FIG. 4, in Step S106, after adjusting the images, the printing of unit images is started again. In Step S107, it is determined whether the printing of the determined number of unit images is completed (Yes) or whether it is not completed (No). When it is determined that the printing is not completed, the process returns to Step S101 and the steps are repeated, whereas, when it is determined that the printing is completed, the sequence ends.

The image-quality adjustment performed in Step S105 may be an adjustment that is different from the color shading adjustment. For example, it may be a gap adjustment in which the distance between the sheet and the nozzle row of each print head is adjusted. If the sheet thickness of the leading sheet 26 and that of the following sheet 27 differ from each other, and, if the position of the head is constant, the gaps between the head and respective sheets differ. If the gaps differ, the distance that the ink discharged from the nozzle falls until it lands on a sheet surface (that is, the time taken for the ink discharged from the nozzle to land on the sheet surface) changes. As a result, the precision with which the ink drops on a landing position also changes. Therefore, the image quality of the leading sheet 26 and that of the following sheet 27 may differ from each other. As mentioned above, not only can the detecting unit 31 detect a splice, but it can also detect the thickness of a sheet. Even if, in accordance with a detected sheet thickness, the head holder 10 holding the print head unit 30 is moved in the direction of arrow B, and the thicknesses of the leading sheet 26 and the following sheet 27 are different from each other, control is performed so that a constant gap is maintained. That is, this exemplary image-quality adjustment is an operation in which the gap is kept constant regardless of the difference between the sheet thicknesses.

Another example of the image-quality adjustment performed in Step S105 is a color registration adjustment of a plurality of print heads. If the friction coefficient of a sheet surface or a sheet thickness changes, a feed amount of the sheet by the conveying rollers changes slightly. Therefore, at the plurality of print heads, print positions for respective colors are shifted relative to each other, thereby reducing the precision with which inks of the respective colors that differ from each other overlap each other. This influences the image quality of a print. This is corrected by performing the color registration adjustment. More specifically, using the print heads for the respective colors, adjustment patterns for performing the color registration adjustment are printed separately on a leading area of the following sheet that follows a splice. The scanner apparatus 19 reads the relative positions in a sheet conveying direction between the printed adjustment patterns of the respective colors. On the basis of read results, the controlling unit 6 corrects discharge timings of the inks of the respective colors, and causes the inks of the respective colors to land precisely on their landing positions. Even if the characteristics of the leading sheet 26 and those of the following sheet 27 are different from each other, color misregistration of the respective colors with respect to the following sheet 27 is automatically corrected, so that an image quality of the following sheet 27 is maintained as high as that of the leading sheet 27.

Although three examples of image-quality adjustment are described, any of these may be used in combination to perform a plurality of adjustments. Sheet consumption can be reduced when the area of the following sheet that is subjected to the image-quality adjustment is closer to a splice. However, it need not be a leading area that immediately follows the leading sheet.

Although, in the above-described embodiment, the sheet information of the following sheet 27 is obtained by the detecting unit 31, the sheet information may be obtained by other methods. For example, it is possible to provide the sheet information of the following sheet 27 on a sheet itself, and to read the sheet information to perform the image-quality adjustment.

FIG. 2A shows an example in which a code pattern 28 is previously recorded at a position immediately following a splice of a sheet S (that is, a leading portion of the following sheet 27). When the code pattern 28 is read by the detecting unit 31, it is possible to obtain the sheet information of the following sheet 27. The code pattern 28 is used to record the information of the following sheet 27 (such as sheet type, sheet characteristics, and sheet thickness) in the form of a bar code. The code pattern 28 is not limited to being recorded on the following sheet 27. It may also be recorded on the tape 25 or on the back edge of the leading sheet 26 in a readable form. It is possible to provide the sheet information as a magnetic pattern instead of as an optical pattern and read the code with a magnetic sensor. It is also possible to bury an IC tag in the sheet and electronically provide the sheet information, to read the information by a non-contact method.

According to the embodiment, the image-quality adjustment is performed on a leading area of the following sheet that follows a splice of the continuous sheet. Therefore, even if the sheet characteristics in front of and behind the splice are different from each other, it is possible to continue printing with the same print image quality that does not cause a user to look at a print with an improper color tone, etc.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-111533 filed May 13, 2010, which is hereby incorporated by reference herein in its entirety.

What is claimed is:

1. An apparatus comprising:

a sheet feeding unit configured to feed a continuous sheet along a path, wherein the continuous sheet includes a leading sheet connected to a following sheet by a splice;

a print head unit of an inkjet-type configured to print adjustment patterns and images on the continuous sheet fed from the sheet feeding unit;

a detecting unit configured to detect the splice of the continuous sheet at a position between the sheet feeding unit and the print head unit in the path;

a reading unit configured to read adjustment patterns on the continuous sheet printed by the print head unit; and an adjusting unit configured to perform an image-quality adjustment of the print head unit, wherein, in response to the splice being detected by the detecting unit, the adjusting unit performs an image-quality adjustment by obtaining information regarding a recordable area of the following sheet and using the obtained information to perform image-quality adjustment of the print head unit that is at least one of a color shading adjustment, a distance adjustment of a gap between the print head unit and the continuous sheet, and a color registration adjustment of the print head unit, wherein the adjusting unit causes the print head unit to print adjustment patterns on a leading area of the following sheet and causes the reading unit to read the adjustment patterns to obtain read image data as the information, the image-quality adjustment being performed based on the read image data, and wherein the adjusting unit further obtains information regarding a recordable area of the leading sheet and, in response to a difference between the information regarding the recordable area of the following sheet and the information regarding the recordable area of the leading sheet, the adjusting unit performs control to print images on the following sheet such that differences between print qualities at portions of the leading sheet in front of the splice and of the following sheet behind the splice are reduced due to the image-quality adjustment.

2. The apparatus according to claim 1, wherein the image-quality adjustment is additionally performed based on information about the continuous sheet that follows the splice, which is obtained by the detecting unit reading the adjustment patterns on the continuous sheet.

3. The apparatus according to claim 1, wherein the recordable area sheet information of the continuous sheet that follows the splice is pre-recorded on top of the continuous sheet as a code pattern, and the image-quality adjustment is additionally performed based on a reading of the code pattern by the detecting unit.

4. The apparatus according to claim 1, further comprising a head holder holding the print head unit, wherein the head holder is movable for changing a gap between the print head unit and a surface of the continuous sheet, wherein the adjusting unit causes the head holder to perform the distance adjustment of a gap between the print head unit and the following sheet in response to the obtained information.

5. The apparatus according to claim 4, wherein the detecting unit is configured to detect a height of the sheet surface as the information.

6. The apparatus according to claim 1, wherein the adjusting unit performs color shading adjustment by determining densities of respective colors from the read image data and uses a result of that determination to adjust actual ink discharge energy applied to print heads of the print head unit.

7. The apparatus according to claim 1, wherein the read image data represents relative positions in a sheet conveying direction between the printed adjustment patterns of respective colors, and wherein the adjusting unit performs color registration adjustment by using the read image data to correct discharge timings of inks of the respective colors.

8. The apparatus according to claim 1, wherein the splice is a first splice and the following sheet is a first following sheet that is connected to a second following sheet by a second splice, wherein the adjusting unit performs image-quality adjustment of the print head unit after printing images on each of the first following sheet and the second following sheet with respect to a design value.

9. The apparatus according to claim 1, wherein, to print images on the following sheet after printing images on the leading sheet connected to the following sheet by the splice, the adjusting unit performs the image-quality adjustment of the print head unit after printing images on the leading sheet such that images are printed on the following sheet with same image quality as printed on the leading sheet.

10. A control method for a printing apparatus, the method comprising:

feeding, using a sheet feeding unit, a continuous sheet along a path, wherein the continuous sheet includes a leading sheet connected to a following sheet by a splice;

printing, using a print head unit of an inkjet-type, adjustment patterns and images on the continuous sheet fed from the sheet feeding unit;

detecting the splice of the continuous sheet at a position between the sheet feeding unit and the print head unit in the path;

reading the adjustment patterns printed on the following sheet to obtain read image data which is information regarding a recordable area of the following sheet that follows the splice and;

performing an image-quality adjustment using the information obtained from the read image data to perform image-quality adjustment of the print head unit that is at least one of a color shading adjustment, a distance adjustment of a gap between the print head unit and the continuous sheet, and a color registration adjustment of the print head unit; and obtaining information regarding a recordable area of the leading sheet and, in response to a difference between the information regarding the recordable area of the following sheet and the information regarding the recordable area of the leading sheet, performing control to print images on the following sheet such that differences between print qualities at portions of the leading sheet in front of the splice and of the following sheet behind the splice are reduced due to the image-quality adjustment.

* * * * *